US005501754A

United States Patent [19]

Hiraguri

[11] Patent Number: 5,501,754

[45] Date of Patent: Mar. 26, 1996

[54] METHOD OF ASSEMBLING RAISED DRY-FLOOR

[75] Inventor: Hiroaki Hiraguri, Komagane, Japan

[73] Assignee: Taisei Electronic Industries Co., Ltd., Japan

[21] Appl. No.: 340,436

[22] Filed: Nov. 14, 1994

Related U.S. Application Data

[63] Continuation of Ser. No. 934,245, Aug. 25, 1992, abandoned.

[30] Foreign Application Priority Data

Sep. 11, 1991 [JP] Japan ..... 3-258794
Jun. 10, 1992 [JP] Japan ..... 4-175018

[51] Int. Cl.[6] ..... E04B 5/00; E04F 15/024

[52] U.S. Cl. ..... 156/71; 52/126.2; 52/263; 52/468; 52/506.06; 52/745.21

[58] Field of Search ..... 156/71, 306.6, 156/290; 52/181, 392, 395, 460, 461, 464, 468, 126.6, 741.1, 263, 480, 506.06, 508, 126.5, 747, 745.21

[56] References Cited

U.S. PATENT DOCUMENTS

| | | | |
|---|---|---|---|
| 2,956,652 | 10/1960 | Liskey, Jr. | 52/126.6 |
| 3,290,844 | 10/1963 | Rushton et al. | 52/468 |
| 3,363,381 | 1/1968 | Forrest | 52/464 |
| 3,760,544 | 9/1973 | Hawes | 52/468 |
| 3,868,802 | 3/1975 | Schubach | 52/468 |
| 3,938,295 | 2/1976 | Tate | 52/126.6 |
| 4,035,967 | 7/1977 | Harvey | 52/126.6 |
| 4,481,747 | 11/1984 | Tengesdal | 52/460 |
| 4,656,795 | 4/1987 | Albrecht | 52/126.6 |
| 4,850,163 | 7/1989 | Kobayashi | 52/126.6 |

FOREIGN PATENT DOCUMENTS

| | | |
|---|---|---|
| 0138236 | 4/1985 | European Pat. Off. . |
| 0411568 | 2/1991 | European Pat. Off. . |
| 2328179 | 12/1974 | Germany . |
| 2915115 | 12/1979 | Germany . |
| 317348 | 1/1991 | Japan . |

*Primary Examiner*—Michael W. Ball
*Assistant Examiner*—Daniel J. Stemmer
*Attorney, Agent, or Firm*—Ronald P. Kananen

[57] ABSTRACT

A method of assembling a raised dry-floor wherein floor panels are laid by using in combination a group of unit supporting legs each comprised of a rod-shaped leg member and a supporting plate mounted on the upper end of the rod-shaped leg member in such a manner that it may be moved up and down to adjust the level thereof, and a group of square and/or rectangular floor panels. The method comprises the steps of disposing a plurality of unit supporting legs on the surface of a foundation floor at prescribed pitches corresponding to the configuration of the floor panels, disposing a plurality of floor panels leaving prescribed gaps therebetween in such a manner that they may be supported at their marginal portions by the unit supporting legs, and then disposing a gap bridging member in each of the gap portions between the floor panels. The levels of the floor panels can be set even by adjusting the supporting plates of the unit supporting legs, after the floor panels are laid. After the raised floor is assembled by laying all the floor panels in this way, a floor covering material is laid on the upper surfaces of the floor panels. The gap bridging member may be a fitting member adapted to be inserted into the gap between the adjoining floor panels or a gap covering member adapted to be placed on the marginal portions of the adjoining floor panels in such a way as to cover the gap.

8 Claims, 12 Drawing Sheets

METHOD OF ASSEMBLING RAISED DRY-FLOOR

This application is a continuation of application Ser. No. 07/934,245 filed Aug. 25, 1992, now abandoned.

BACKGROUND OF THE INVENTION

1. Field of the Invention

This invention relates to a method of assembling a raised dry-floor so as to form a space between the floor and the surface of the existing foundation floor or sub-floor in a variety of buildings such as apartment houses, mansions and the like, and a raised dry-floor unit used for carrying out the method, and more particularly to the arrangements of floor panels and members for bridging the gaps between the floor panels.

2. Description of the Prior Art

Raised floors have been constructed by supporting a plurality of floor panels formed out of wood, metal, concrete, calcium silicate based material, etc. by means of a plurality of supporting legs installed on a foundation floor or sub-floor at a predetermined height, and the spaces between the existing foundation floor faces and the raised floors are utilized as that for passing various kinds of pipings such as water supply and drainage pipes and gas supply pipes, that for passing electrical and communication wirings, that for installing air-conditioning ducts or cooling and heating ducts under the raised floor, that for laying thermal insulation materials or sound-proofing materials under the raised floor, and also as air-conditioning ducts or the like for enhancing the sound-proofing effect or the thermal insulation effect.

A prior art method of assembling a raised dry-floor is, as shown in FIG. 1, to put side by side floor units 3 each comprised of a square or rectangular floor panels 4 of a predetermined dimension having four to six supporting legs 5 attached to the four corners and the central part thereof on a concrete slab (foundation floor or sub-floor) 1, and then lay intermediate plywood laminates 6 thereon. The numeral 2 indicates a wall or a partition wall. In an alternative method, as shown in FIG. 2, floor units **3*a* each comprised of two sheets of floor panels 4 adhesively bonded and having supporting legs 5** attached to the lower panel only on one side thereof where the other floor panel is not lapped on are used, and when joining adjacent floor units, the opposite side of the upper panel of one floor unit to which the supporting legs are not attached is placed on the supporting leg attached portion of the lower panel of the other floor unit. In this case too, intermediate plywood laminates are laid on the raised floor thus assembled.

Further, another method of assembling a raised dry-floor using plywood floor panels in the same manner as the method shown in FIG. 2, but without using intermediate plywood laminates has also been proposed. In this case, use is made of a construction wherein a rectangular panel 7 is lapped on a L-shaped frame plate 9 only in the joined portion (i.e., the portion to which supporting legs 8 are attached), and the remainder portion is formed by only one sheet of plywood laminate (rectangular panel), and also in the joined portion the panel 7 of the other floor unit is consequentially supported by only one sheet of plywood laminate (frame plate 9) as shown in FIG. 3 Therefore, it is anticipated in the actual execution of work that it will become essential to lay intermediate plywood laminates on the raised floor thus assembled in order to obtain a sufficient strength in the joints of floor units **3*b*. Further, this method requires working and machining operations such as attaching work of a frame plate 9 to each of floor panels 7** and drilling operation at a factory with the result that an increase in the cost thereof in terms of materials and labor is unavoidable.

As described herein above, the prior art method of assembling a raised floor is to dispose floor units closely or at predetermined intervals on a foundation floor or sub-floor, and then lay intermediate plywood laminates thereon. In case a floor covering material, in particular, a soft or flexible floor covering material, such as a floor covering sheet and a carpet, is directly laid on the floor units thus constructed, without laying the intermediate plywood laminates, even if the floor panels are laid closely, a step-like difference in level will be created between the adjacent floor panels. On the other hand, in case floor panels are disposed leaving predetermined gaps between them, each time a person treads on the gap portions between the floor panels, the gap portions are liable to sink, making it difficult to walk thereon, and also a problem on the strength of the gap portions will arise. Therefore, it becomes inevitable to lay intermediate plywood laminates on the floor panels. Consequently, increase in the cost due to the material expenses of the intermediate plywood laminates and increase in the personnel expenditure due to the labor for laying the intermediate plywood laminates, and a prolongation in the term of work become unavoidable.

However, in view of the manpower shortage and the increase in prices of commodities at the present time, a method of assembling a raised dry-floor which requires labor as little as possible and can be carried out at a low cost has been sought after.

Japanese Patent Application laid open to public inspection, KOKAI No. HEI 3-17348 discloses a method of assembling a raised dry-floor which uses in combination a group of unit supporting legs each comprised of a rod-shaped leg member and a supporting plate mounted on the upper end of said rod-shaped leg member in such a manner that it may be moved up and down to adjust the level thereof, and a group of rectangular floor panels each having a predetermined dimension. This method is to dispose the unit supporting legs on the surface of a foundation floor at prescribed pitches, and dispose floor panels leaving predetermined gaps therebetween such that they are supported by the above-mentioned unit supporting lees at positions along their marginal portion and longitudinal center lines. By this method, the floor panels can be laid comparatively simply and efficiently. In this method too, however, since the floor panels are laid leaving predetermined gaps between them and supported at the marginal portions by the unit supporting legs, intermediate plywood laminates are laid on the floor panels thus assembled, and also a floor covering material is laid thereon. In case the intermediate plywood laminates are not laid all over the floor panels, each time a person treads on the gap portions between the floor panels with his feet, he is sensible of the presence of the gap portions through his soles and his body weight bears generally on either one of the floor panels so that a problem will arise wherein a step-like difference in level is created between the adjoining floor panels thus worsening the stability of the floor and he has a sense of incompatibility through sensing the presence of the step-like difference in level through his soles.

SUMMARY OF THE INVENTION

Accordingly, an object of the present invention is to provide a method whereby a raised dry-floor can be assembled in a relatively simple manner without having to use intermediate plywood laminates.

Another object of the present invention is to provide a method whereby a raised dry-floor can be assembled at such an even floor level that when a person treads on the gap portions between the floor panels with his feet, no step-like difference in level is created between them in spite of using no intermediate plywood laminates and the walker does not have any sense of incompatibility.

A further object of the present invention is to provide a method of assembling a raised dry-floor having a sufficient strength without having to use intermediate plywood laminates even in case a thin, soft or flexible floor covering material such as a floor covering sheet, a carpet or the like is used, and whereby the assembling work can be carried out efficiently and simplified.

A still further object of the present invention is to provide a method whereby a raised dry-floor which is excellent in terms of the strength and stability thereof can be assembled without having to use intermediate plywood laminates.

An yet further object of the present invention is to provide a method of assembling a raised dry-floor which requires no laying operation of intermediate plywood laminates, thereby the material cost of the intermediate plywood laminates can be saved and a reduction in the assembling costs thereof and a curtailment in the term of work can be achieved.

An even further object of the present invention is to provide a method of assembling a raised dry-floor whereby a floor covering material can be applied simply.

It is another object of the present invention to provide a raised dry-floor unit which can be put to use advantageously in order to assemble the above-mentioned raised dry-floor.

A further object of the present invention is to provide a raised dry-floor wherein a rising of the floor due to expansion of the floor panels and creak of the floor can be prevented.

To achieve the above-mentioned objects, according to a first aspect of the present invention, there is provided a method of assembling a raised dry-floor wherein floor panels are laid by using in combination a group of unit supporting legs each comprised of a rod-shaped leg member and a supporting plate mounted on the upper end of said rod-shaped leg member in such a manner that it may be moved up and down to adjust the level thereof, and a group of square and/or rectangular floor panels, the method comprising the steps of disposing a plurality of unit supporting legs on the surface of a foundation floor or sub-floor at prescribed pitches corresponding to the configuration of the floor panels, disposing a plurality of floor panels leaving prescribed gaps therebetween in such a manner that they may be supported at their marginal portions by the above-mentioned unit supporting legs, and then disposing a gap bridging member in each of the gap portions between the floor panels. Adjustments of the level of the floor panels can be performed by adjusting the level of the supporting plates of the above-mentioned unit supporting legs, after the floor panels have been laid. After a raised floor has been assembled by laying all the floor panels in the above-mentioned way, a floor covering material is laid on the upper surfaces of the floor panels.

The above-mentioned gap bridging member may be a fitting member or embedding member adapted to be fitted in the above-mentioned gap between the adjoining floor panels such as, for example, a solid member of a square or rectangular section or a hollow member of a U-shaped section having the same thickness as that of the floor panel and a width corresponding to the width of the above-mentioned gap, or a gap covering member adapted to be placed on the marginal portions of the adjoining floor panels in such a way as to cover the above-mentioned gap.

According to the second aspect of the present invention, there is provided a method of assembling a raised dry-floor wherein floor panels are laid by using in combination a group of unit supporting legs each comprised of a rod-shaped leg member and a supporting plate mounted on the upper end of said rod-shaped leg member in such a manner that it may be moved up and down to adjust the level thereof, and a group of square and/or rectangular floor panels, the method comprising the steps of disposing a plurality of unit supporting legs on the surface of a foundation floor at prescribed pitches corresponding to the configuration of the floor panels, disposing a plurality of floor panels leaving prescribed gaps therebetween in such a manner that they may be supported at their marginal portions by said unit supporting legs, disposing a gap covering member having sufficient strength and flexibility and having an adhesive layer on the upper surface thereof on the marginal portions of the adjoining floor panels in such a way as to cover each of said gaps between the adjoining floor panels, and laying a floor covering material thereon so as to fixedly secure it by means of said adhesive layer.

Further, according to the third aspect of the present invention, there is provided a method of assembling a raised dry-floor wherein floor panels are laid by using in combination a group of unit supporting legs each comprised of a rod-shaped leg member and a supporting plate mounted on the upper end of said rod-shaped leg member in such a manner that it may be moved up and down to adjust the level thereof, and a group of rectangular and/or square floor panels, the method comprising the steps of disposing a plurality of unit supporting legs on the surface of a foundation floor or sub-floor at prescribed pitches corresponding to the configuration of the floor panels, disposing a plurality of floor panels each having holes or notches formed in the marginal portion thereof at regular intervals corresponding to the positions of the rod-shaped leg members of the unit supporting legs and whose dimentions are nearly equal to or somewhat larger than the diameter of the rod-shaped leg members, leaving extremely small gaps therebetween (to such a degree that no cavity is formed in case a floor covering sheet or a carpet is laid, and also a problem such as rising Of the floor panels due to expansion thereof does not arise) in such a manner that the holes or notches correspond to the rod-shaped leg members of the unit supporting legs and the marginal portions of the floor panels are supported by the unit supporting legs, and then inserting fitting members or embedding members whose sizes are nearly equal to that of each of the holes or notches formed in the marginal portions of the above-mentioned floor panels into such holes or notches.

To advantageously perform the aforementioned methods, according to the present invention, there is further provided a raised dry-floor unit comprising a plurality of unit supporting legs each comprised of a supporting plate having an insertion hole formed in the central part thereof and also having an adhesive sheet affixed onto the upper surface thereof, a level adjusting nut whose upper portion is adapted to be inserted in the insertion hole in said supporting plate and having a projecting annular supporting portion formed on the outer periphery of the lower end thereof, a supporting bolt whose upper screw-threaded portion is threadably engaged with said adjusting nut, and a pedestal fixedly secured to the lower end portion of the supporting bolt; and a plurality of square or rectangular floor panels to be laid such that the marginal portions thereof may be supported by said unit supporting legs. In one preferred mode, the raised dry-floor unit further comprises a plurality of gap bridging members adapted to be disposed in the gap portions between the floor panels. In another preferred mode, there is used the floor panels each having holes or notches formed in the marginal portion thereof at regular intervals corresponding to the positions of the rod-shaped leg members of the unit supporting legs and whose dimensions are nearly equal to or somewhat larger than the diameter of the rod-shaped leg members, and the raised dry-floor unit further comprises a plurality of fitting members adapted to be inserted into said holes formed in the marginal portions of said floor panels.

DETAILED DESCRIPTION OF THE PREFERRED EMBODIMENTS

Figure 1:
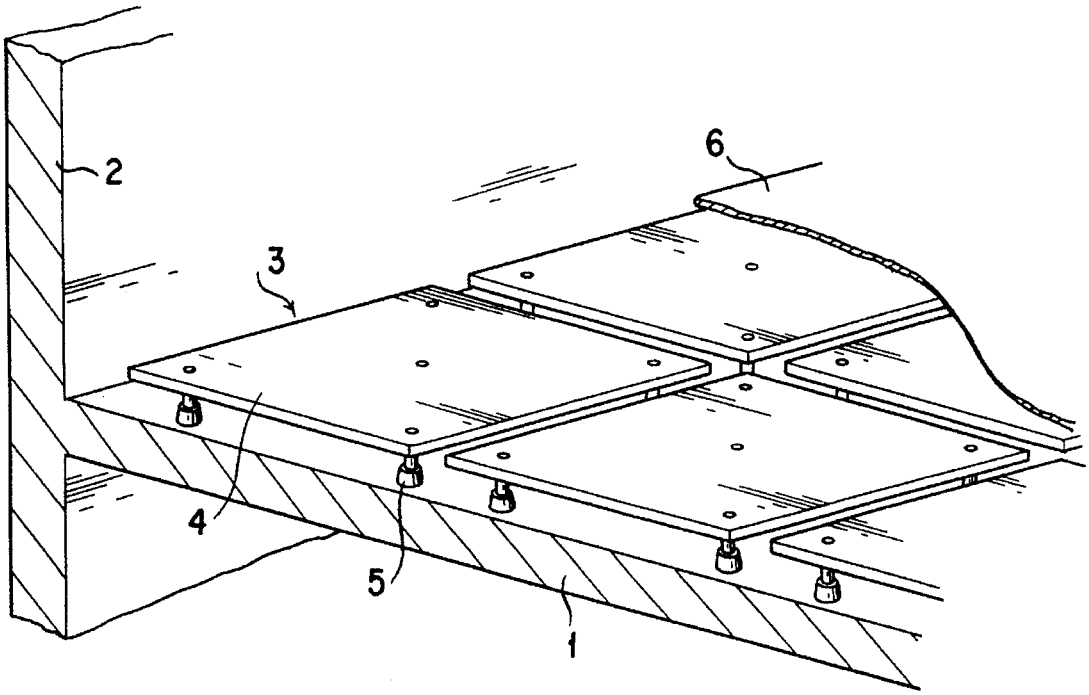
FIG. 1 (PRIOR ART)
FIG. 1 is a cutaway perspective view showing an example of the method of assembling a raised floor using prior art floor units on a building site.
Figure 2:
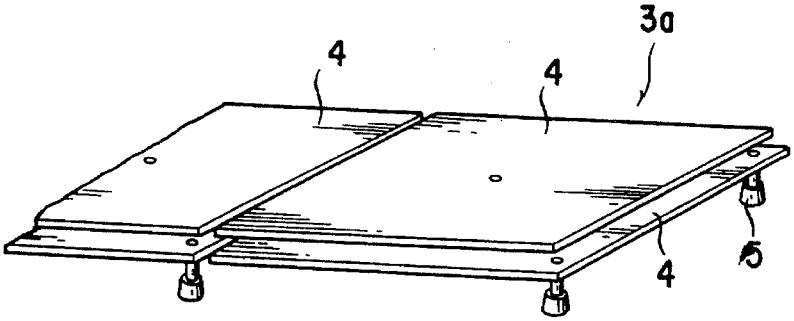
FIG. 2 (PRIOR ART)
FIG. 2 is a fragmentary perspective view showing another example of floor units for use in a prior art raised floor in assembled conditions.
Figure 3:
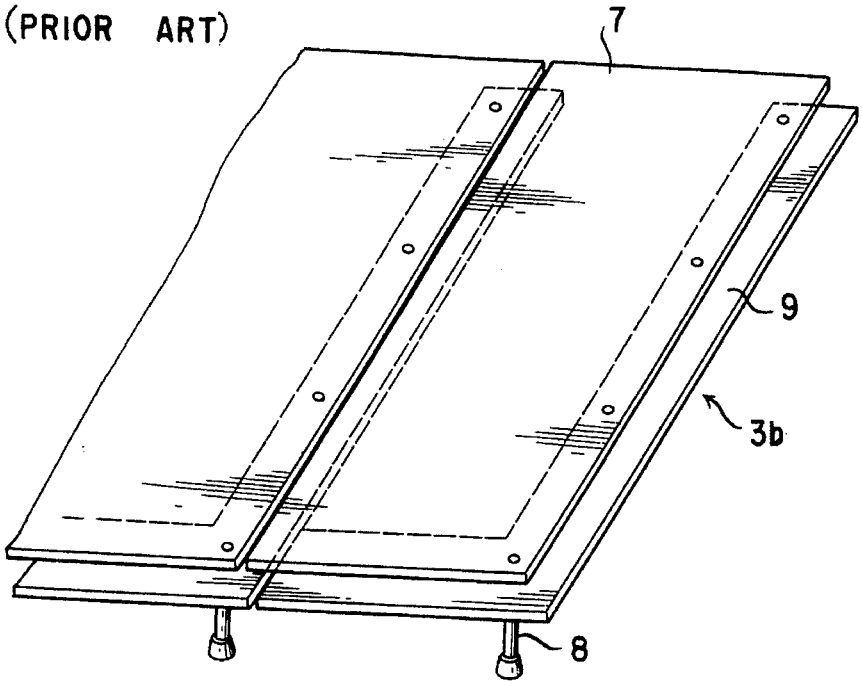
FIG. 3 (PRIOR ART)
FIG. 3 is a fragmentary perspective view showing a further example of floor units for use in a prior art raised floor in assembled conditions.
Figure 4:
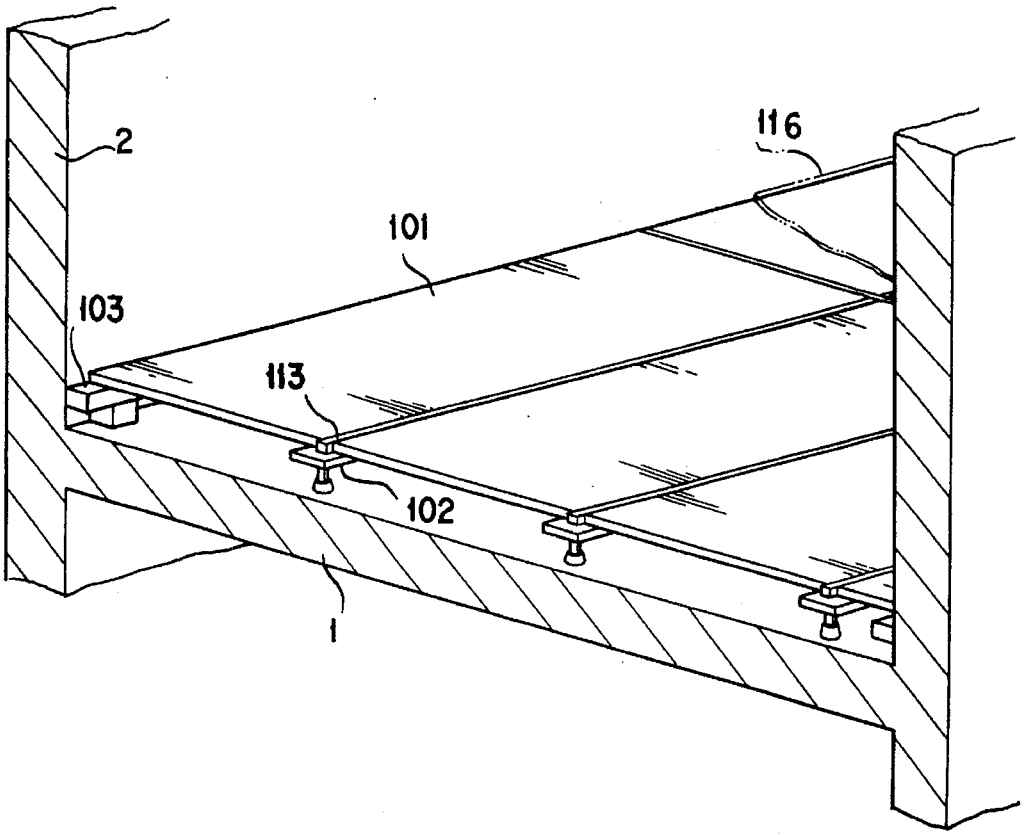
FIG. 4 is a cutaway perspective view showing a first embodiment wherein floor panels are laid on an ordinary site using a method of assembling a raised floor according to the present invention and gap bridging members are fitted in the gap portions.

FIG. 4 shows one embodiment of the method of assembling a raised dry-floor on a foundation floor 1 according to the present invention.

Figure 5:
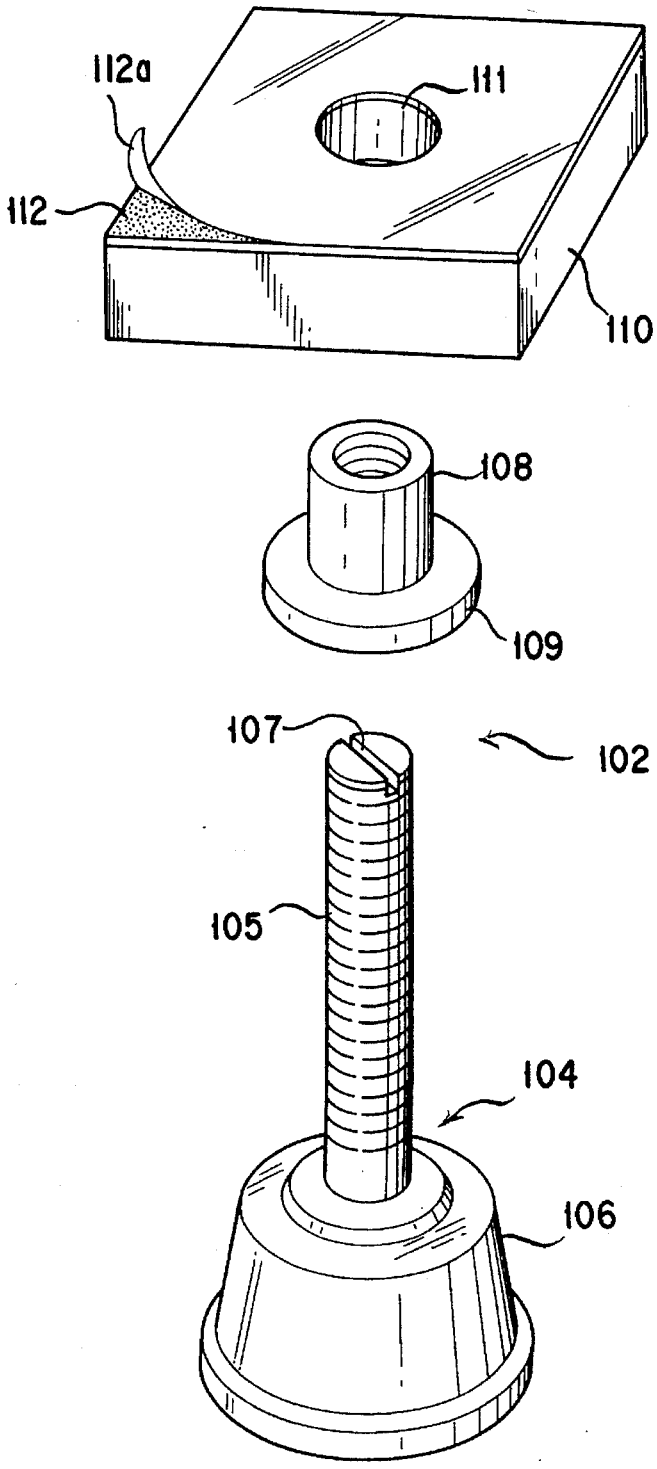
FIG. 5 is an exploded perspective view of a unit supporting leg for use in the method of assembling a raised dry-floor according to the present invention.
Figure 6:
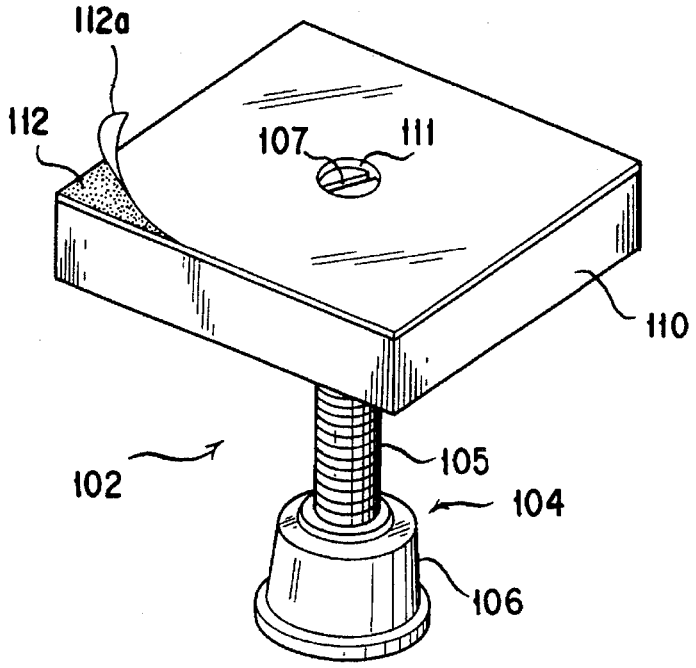
FIG. 6 is a perspective view of an assembly of the unit supporting leg shown in FIG. 5.

A unit supporting leg 102 does not differ in the basic construction thereof from known ones, and is made up of, as shown in FIGS. 5 and 6, a rod-shaped leg member 104 comprised of a supporting bolt 105 whose lower end is implanted in an antivibration pedestal 106 made of a resilient material such as rubber or the like, a level adjusting nut 108 having a projecting annular supporting portion 109 formed on the outer periphery of the lower end thereof, and a supporting plate 110 having an insertion hole 111 formed in the central part thereof and also having an adhesive sheet 112 affixed onto the upper surface thereof. The level adjusting nut 108 is attached to the supporting plate 110 by fitting it into the insertion hole 111 bored in the latter, or alternatively the nut 108 may be attached to the supporting plate 110 by affixing an annular adhesive sheet (not shown) onto the upper surface of the supporting portion 109, and then affixing the adhesive sheet on the lower surface of the supporting plate 110 around the insertion hole 111 upon insertion of the nut 108 thereinto. The supporting bolt 105 of the rod-shaped leg member 104 is screwed into the level adjusting nut 108 thus fitted in the insertion hole 111 of the supporting plate 110 so as to form the unit supporting leg assembly 102 as shown in FIG. 6. Further, the upper end surface of the supporting bolt 105 is formed with a minus groove 107 (which may be a plus groove or a polygonal groove). By fitting the leading end of a turning tool such as a driver or the like in the groove 107 and turning the tool so as to turn the rod-shaped leg member 104, the level adjusting nut 108 and the supporting plate 110 in which the nut 108 is fitted are moved up or down so that the level of the surface of the floor panel supported by the supporting plate 110 can be adjusted. Upon use of the unit supporting leg 102, a release paper 112*a* on the upper surface of the adhesive sheet 112 is peeled off.

Figure 7:
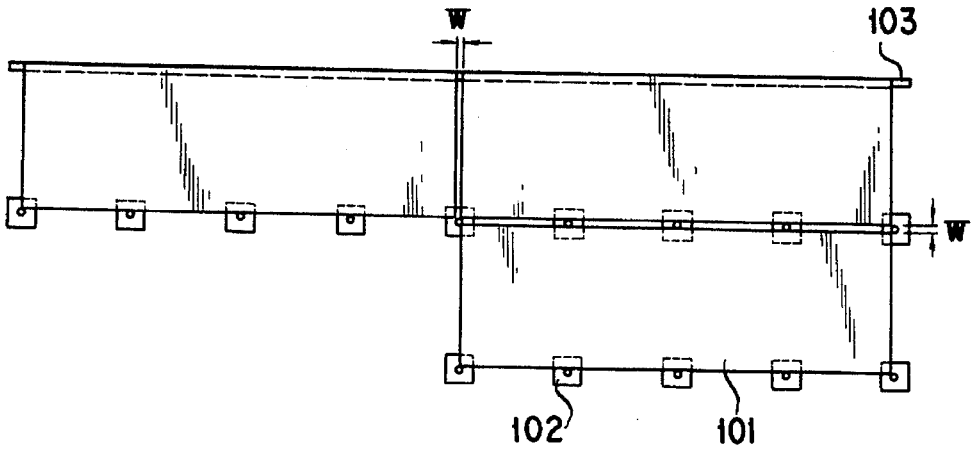
FIG. 7 is a fragmentary plan view showing an example of the layout of raised floor wherein the floor panels have been assembled using the method of assembling a raised dry-floor according to the present invention.

FIG. 7 shows an arrangement or layout of floor panels assembled in position. Floor panels 101 are disposed leaving prescribed gaps W nearly equal to the diameter of the supporting bolt 105 therebetween so that they may be supported at their marginal portions by means of the unit supporting legs 102.

At a building site, as shown in FIG. 4, a floor joist or floor joist unit 103 is attached to each of walls 2 (or partitions) of a room at a predetermined, fixed height so as to support one side of the floor panel 101 placed thereon. The other marginal portion of the floor panel 101 which is not placed on the floor joist 103 is mounted on the unit supporting legs 102 disposed on a foundation floor 1 at pitches of about 450 mm. Each of the floor panels 101 is attached to the unit supporting legs 102 through the intermediary of the adhesive sheets 112 affixed onto the upper surfaces of the supporting plates 110 of the latter. The insertion holes 111 formed in the supporting plates 110 of the unit supporting legs 102 are kept in exposed condition. An adjoining floor panel is also mounted in the same manner on the unit supporting legs 102 already installed leaving a prescribed gap between itself and the floor panel already mounted so as to enable the levels of the floor panels to be adjusted, and the other unit supporting legs 102 are installed in position and the adjoining floor panel 101 is mounted thereon. The level of the floor panel 101 (the levels of the upper surfaces of the supporting plates 110) is adjusted by turning a driver or the like whose leading end is fitted in the groove 107 formed on the upper end surface of the supporting bolt 105 through said insertion hole 111 so as to turn the rod-shaped leg member 104.

Such operations are repeatedly made, and in narrow places such as corners of the room where regular-sized floor panels cannot be disposed, after floor joists have been installed, the regular-sized floor panels are cut to dimensions and the unit supporting legs are disposed at proper positions, and then the floor panels adjusted in dimensions are laid in such places.

Figure 8:
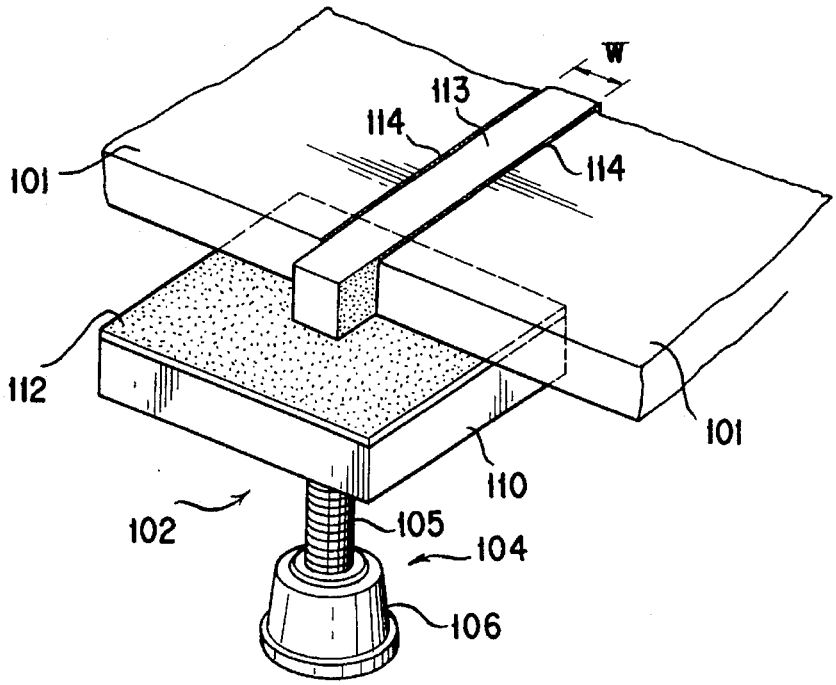
FIG. 8 is a fragmentary perspective view of the first embodiment shown in FIG. 4 wherein a fitting member is inserted in the gap between adjoining floor panels using the method of assembling a raised dry-floor according to the present invention.
Figure 9:
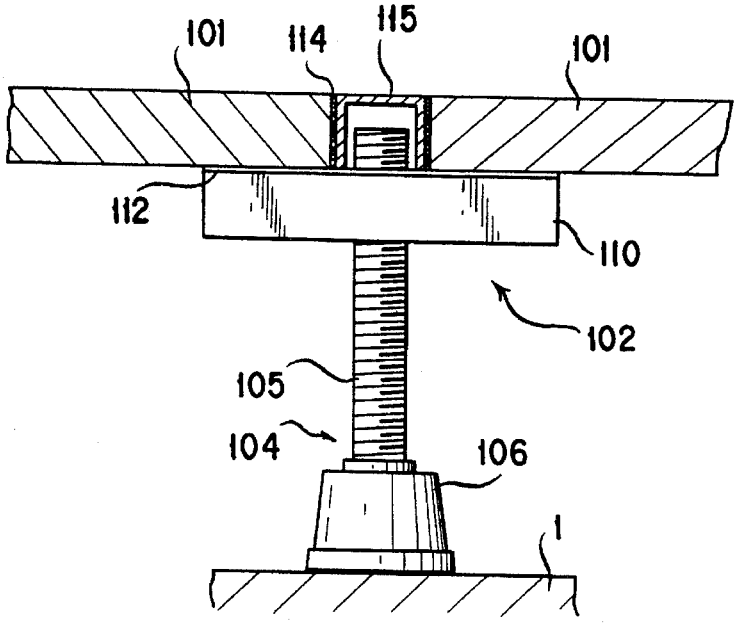
FIG. 9 is a fragmentary sectional view showing another embodiment of the method of assembling a raised dry-floor according to the present invention wherein a cap member is fitted in a gap portion between the adjoining floor panels corresponding to the rod-shaped leg member of the unit supporting leg.

After that, as shown in FIGS. 4 and 8, a fitting member 113 whose thickness is the same as that of the floor panels 101 and whose width is the same as a predetermined gap W between the adjoining floor panels 101 is fitted in the gap W with the supporting plate 110 of the unit supporting leg 102 under both floor panels 101 serving as the supporting base thereof, and fixedly secured to the supporting plate 110 through the intermediary of the adhesive sheet 112 affixed onto the upper surface thereof. Further, in case after the adjustment of the levels of the floor panels the upper end of the supporting bolt 105.of the rod-shaped leg member 104 projects from the supporting plate 110 of the unit supporting leg 102 as shown in FIG. 9, a cap-shaped fitting member of a hollow, square tube configuration, i.e. a bolt cover 115 is fitted in the gap between the adjoining floor panels at the position corresponding to the supporting bolt 105. The fitting members 113 and the bolt covers 115 are fitted in all the gaps between the floor panels 101 in this way. Alternatively, in the course of laying the floor panels, they may be laid by previously inserting the fitting members 113 in the gaps between the floor panels while using the members 113 as feeler gauges. After that, a floor covering material 116 such as a cushioning floor covering sheet, a carpet or the like is laid on the floor panels 101 thus assembled.

The configuration of the fitting member 113 is not limited to the solid member of square or rectangular section as shown, but members having a variety of shapes and a sufficient strength may be used, for example, a hollow member having a U-shaped section may be used. The above-mentioned fitting member 113 and bolt cover 115 may be made of wood, a metal, and a resin, etc. Further, a cushioning sheet 114 adapted to absorb expansion and contraction of the floor panels is inserted between the floor panel 101 and the fitting member 113. This cushioning sheet 114 is also effective to prevent the occurrence of a creak of floor which tends to occur when a person treads on raised floors.

By using the method of fitting the fitting members in the gaps between the floor panels in this way, the gaps between the floor panels in assembled condition can be stopped simply with the fitting members, and also a cushioning floor covering sheet, a carpet or the like can be laid on the floor panels without having to lay intermediate plywood laminates. Consequently, it becomes unnecessary to provide intermediate plywood laminates, and the material cost of the plywood laminates and the labor for laying them can be eliminated, so that saving in the material cost and the personnel expenditure and a reduction in the term of work can be achieved. Therefore, raised floors can be assembled at a lower cost.

Figure 10:
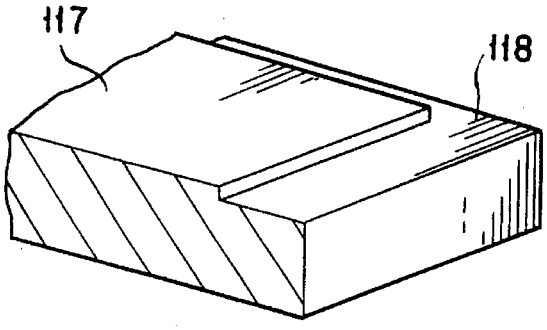
FIG. 10 is a fragmentary perspective view of a floor panel to be used in case a thin plate-shaped fitting member is used as a gap bridging member in the method of assembling a raised dry-floor according to the present invention.
Figure 11:
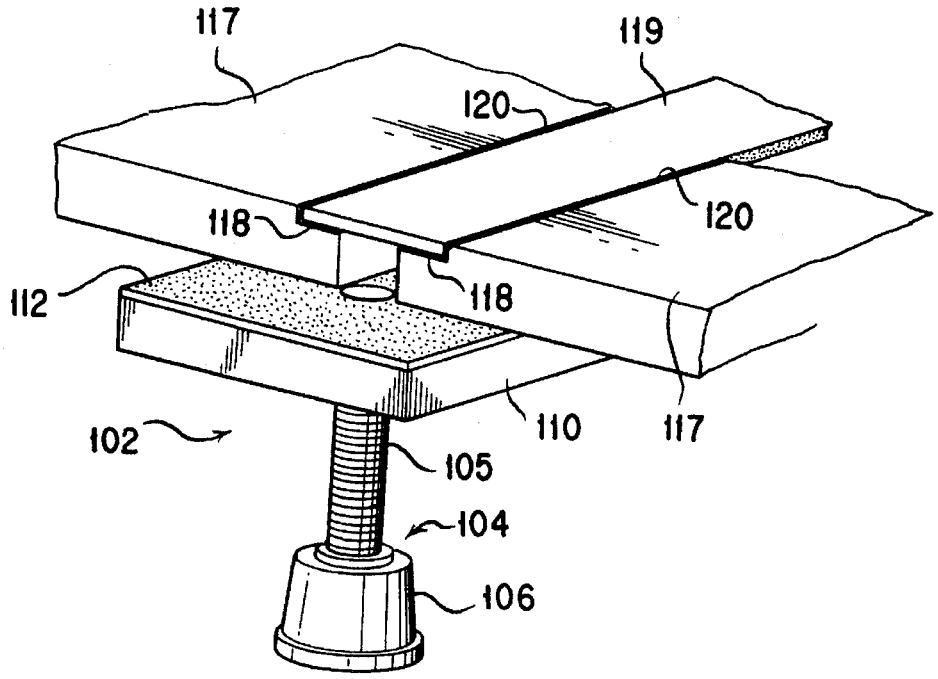
FIG. 11 is a fragmentary perspective view showing a further embodiment of the method of assembling a raised dry-floor according to the present invention wherein a thin plate-shaped fitting member is fitted in between the lower step portions of the adjoining floor panels shown in FIG. 10.

FIGS. 10 and 11 show another embodiment of the present invention in which floor panels 117 each having a lower step portion 118 formed in the marginal portion thereof as shown in FIG. 10 are used in the above-mentioned method of assembling a raised floor. With the floor panels 117 assembled in the condition as shown in FIG. 11, a thin plate-shaped fitting member 119 is fitted in the gap between the floor panels 117 in such a way as to cover and stop the gap with said fitting member, with the lower step portions 118 of the floor panels 117 serving as the supporting surfaces. This thin fitting member 119 has adhesive cushioning sheet 120 affixed onto the portions thereof which are held in contact with the floor panels 117. The adhesive cushioning sheet 120 serves to adhesively bond the fitting member 119 to the floor panels 117, prevent creak of the floor from occurring when a person walks thereon, and also absorb expansion of the floor panels.

Figure 12:
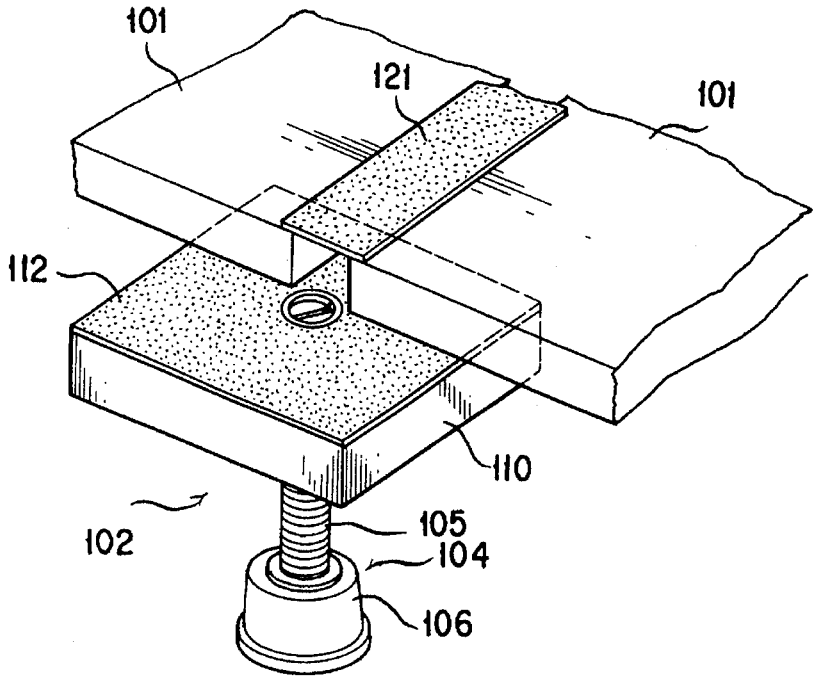
FIG. 12 is a fragmentary perspective view showing another embodiment of the method of assembling a raised dry-floor according to the present invention wherein a gap portion between the adjoining floor panels is covered with a gap covering member.

FIG. 12 shows an embodiment of the method of assembling a raised floor in which a sheet-like gap covering member is used as a member for bridging the gap between the floor panels. After unit supporting legs 102 are installed, floor panels 101 are laid and the floor surface level is adjusted, as shown in FIG. 12, a sheet-like gap covering member 121 having adhesive layers on the upper and lower surfaces thereof and whose width is larger than a gap W between the adjoining floor panels 101 is affixed onto the marginal portions of the floor panels in such a way as to cover the gap W. After that, a floor covering material such as a cushioning floor covering sheet, a carpet or the like (not shown) is laid on the floor panels 101 thus assembled, and fixedly secured in position by means of the adhesive layer on the upper surface of the above-mentioned gap covering member 121. It should be noted that the levels of the floor panels 101 may be adjusted after the gap covering member 121 is affixed onto the marginal portions of the adjoining floor panels 101.

The above-mentioned sheet-like gap covering member 121 is required to possess sufficient strength and flexibility so that in case a difference in level is created between the marginal portions of the adjoining floor panels 101 when a person walks thereon it may follow with the difference in level sufficiently and a gently sloping surface is formed in the gap portion between the adjoining floor panels. The gap covering member may be made, for example, of plastics, metals, etc.

Figure 13:
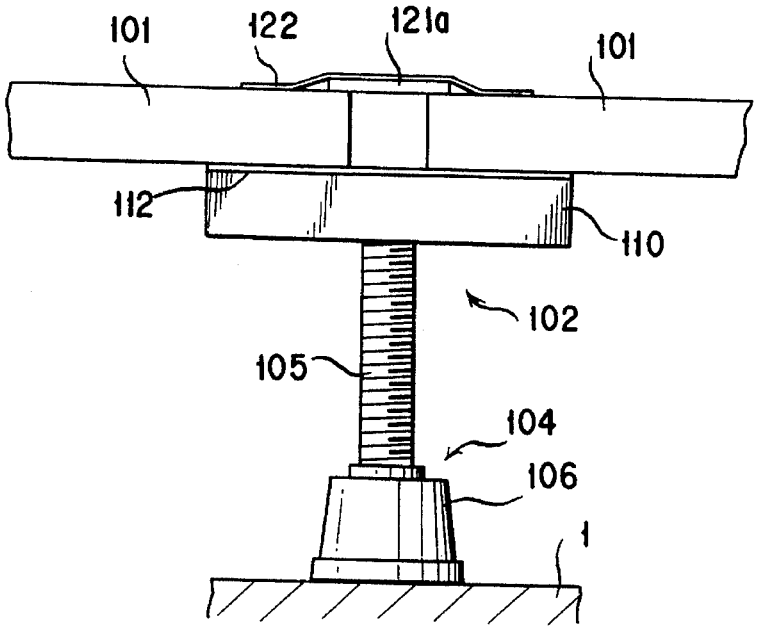
FIG. 13 is a fragmentary end view showing a still further embodiment wherein a gap portion between the floor panels is covered with a gap covering member.

Instead of using the above-mentioned sheet-like gap covering member 121 with adhesive applied onto both surfaces thereof, a sheet-like gap covering member 121*a* to which no adhesive is applied as shown in FIG. 13 may be used. It is possible to dispose the gap covering member 121*a* on the marginal portions of the adjoining floor panels 101 in such a way as to cover the gap therebetween, affix a double-faced adhesive tape 122 thereon so as to fixedly secure the gap covering member 121*a* across the gap portion between the adjoining floor panels 101.

As mentioned hereinabove, according to the above-mentioned embodiments, since a sheet-like gap covering member having sufficient strength and flexibility and having an adhesive layer on the upper surface thereof is laid on the marginal portions of the adjoining floor panels in such a way as to cover the gap therewith and the floor covering material such as a cushioning floor covering sheet, a carpet or the like is laid and fixedly secured in position by means of the above-mentioned adhesive layer, the raised dry-floor can be assembled very simply. Moreover, since the floor panels are supported at their marginal portions by the unit supporting legs in stable condition, there is no problem on the strength of the gap portions between the floor panels, and also since the above-mentioned gap covering member has sufficient strength and flexibility, even if a person treads on the gap portion between the adjoining floor panels with his feet such that his body weight bears on one of the floor panels, a gently sloping surface is formed by the above-mentioned flexible gap covering member across the gap portion between the floor panels. Accordingly, the walker does not have such sense of incompatibility as he senses the presence of the gap portion or the step-like difference in level with his sole, unlike the prior art raised floor. Further, a cushioning floor covering sheet, a carpet or the like can be laid without having to lay intermediate plywood laminates, unlike the prior art method of assembling a raised floor.

Figure 14:
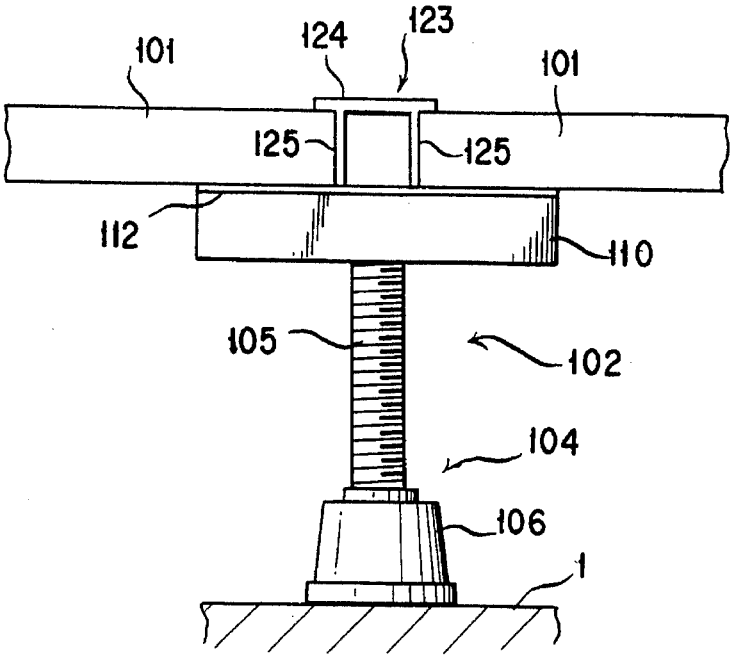
FIG. 14 is a fragmentary end view showing another embodiment of the gap covering member according to the present invention fitted in a gap portion between the floor panels.

FIGS. 14 to 17 show other embodiments of the gap covering member for use in the present invention. A gap covering member 123 shown in FIG. 14 is comprised of two elongated leg portions 125 extending in parallel relationship and a sheet-like upper portion 124 formed integrally with the leg portions, the sheet-like upper portion connecting the upper ends of the leg portions 125 and having longitudinal marginal portions which project outwardly from the leg portions on both sides. The above-mentioned leg portions 125 are inserted in the gap between the adjoining floor panels 101 in such a manner that the longitudinal marginal portions of the sheet-like upper portion 124 may rest on the marginal portions of the floor panels 101. Subsequently, the gap covering member 123 is fixedly secured by means of a double-faced adhesive tape (not shown) in the gap portion between the floor panels 101. After that, a floor covering material such as a cushioning floor covering sheet, a carpet or the like (not shown) is laid on the floor panels 101 thus assembled, and then fixedly secured in position by means of the adhesive layer on the upper surface of the above-mentioned double-faced adhesive tape.

Figure 15:
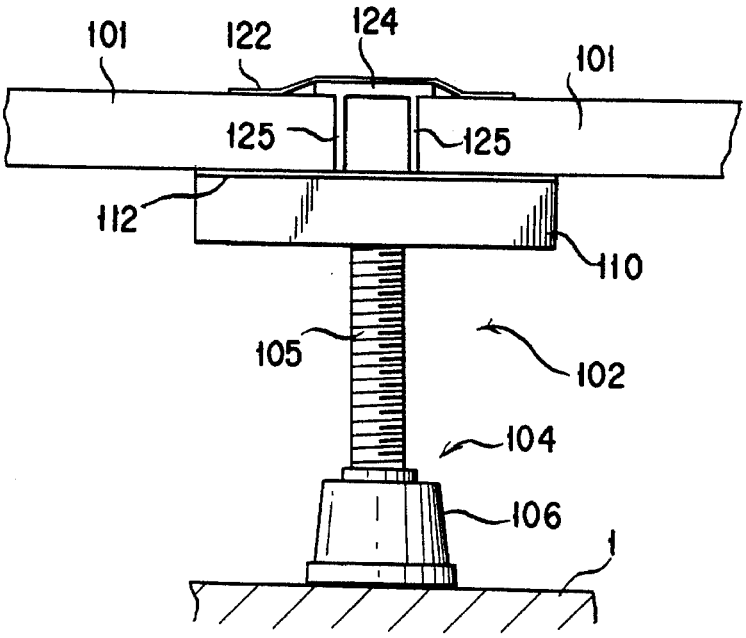
FIG. 15 is a fragmentary end view showing an example of the method of fixedly securing the gap covering member as shown in FIG. 14.
Figure 16:
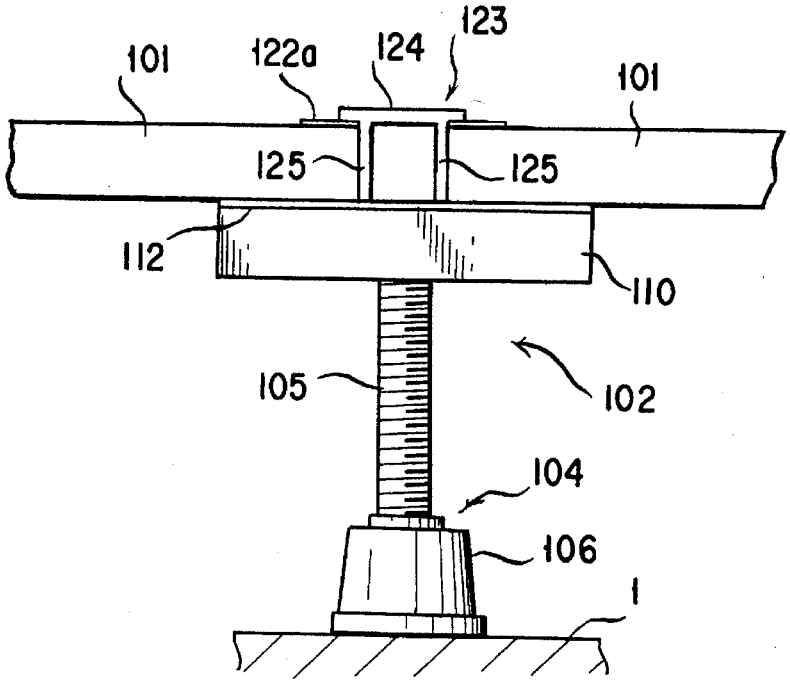
FIG. 16 is a fragmentary end view showing another example of the method of fixedly securing the gap covering member as shown in FIG. 14.

FIG. 15 shows one example of the method of fixedly securing the gap covering member as shown in FIG. 14. After the above-mentioned leg portions 125 are inserted in the gap between the floor panels 101 so that the longitudinal marginal portions of the sheet-like upper portion 124 of the gap covering member 123 may rest on the upper marginal portions of the adjoining floor panels 101 as shown in FIG. 14, a double-faced adhesive tape 122 whose width is larger than that of the sheet-like upper portion 124 of the gap covering member 123 is affixed onto the upper portion 124 and the upper surfaces of the floor panels to fixedly secure the gap covering member 123 in the gap portion between the floor panels 101. On the other hand, FIG. 16 shows another example of the method of fixedly securing the gap covering member. That is to say, a double-faced adhesive tape 122*a* is interposed between the lower surface of the sheet-like upper portion 124 of the gap covering member 123 and the upper surface of each of the floor panels 101 so as to project from the sheet-like upper portion 124, thereby fixedly securing the gap covering member 123 to both floor panels 101 by means of the double-faced adhesive tapes 122*a*. In either case of the above-mentioned methods of fixedly securing the gap covering member, a floor covering material such as a cushioning floor covering sheet, a carpet or the like can be laid and fixedly secured on the floor panels using the above-mentioned double-faced adhesive tapes 122, 122*a*, respectively.

Figure 17:
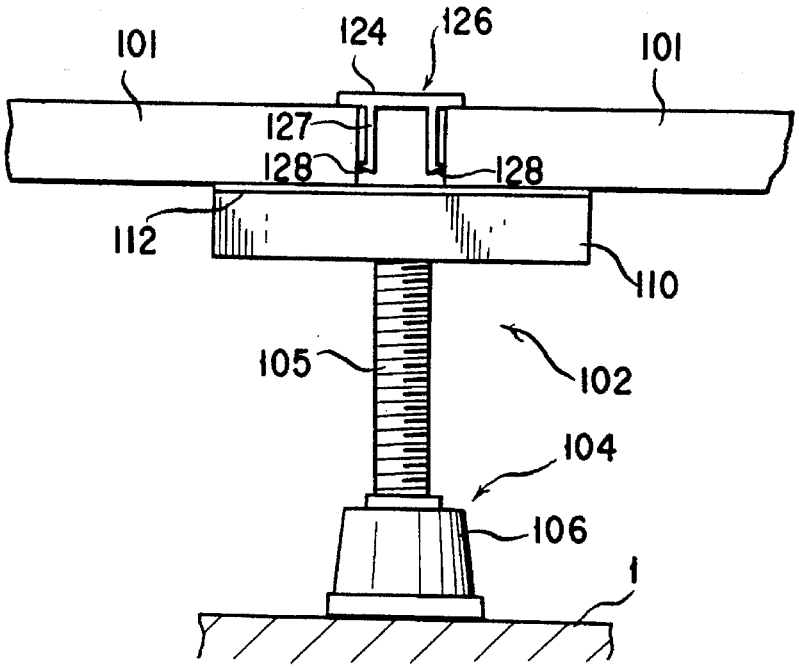
FIG. 17 is a fragmentary end view showing a further embodiment of the gap covering member according to the present invention fitted in a gap portion between the adjoining floor panels.
Figure 18:
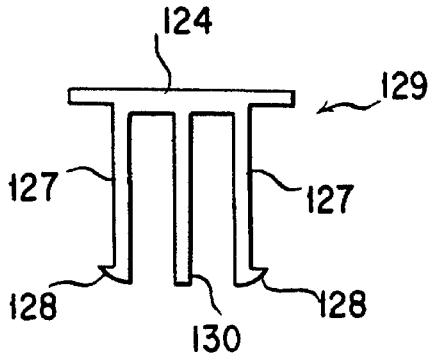
FIG. 18 is an end view showing a modified example of the gap covering member as shown in FIG. 17.

A gap covering member 126 as shown in FIG. 17 has outwardly projecting pawl portions 128 formed integrally with the lower ends of the leg portions 127, respectively, to prevent the gap covering member from slipping out of the gap portion. Further, FIG. 18 shows a modified example of the gap covering member shown in FIG. 17. This gap covering member 129 is comprised of leg portions 127 formed on both sides thereof and having outwardly projecting pawl portions 128 formed integrally with the lower ends thereof, and a further reinforcing leg portion 130 formed integrally therewith so as to extend between the leg portions 127 in parallel therewith. The above-mentioned pawl portions 128 may be formed continuously along the leg portions 127 in the longitudinal direction thereof, respectively, or alternatively they may be formed as a plurality of projections dotted at predetermined intervals in the longitudinal direction of the leg portions 127. Further, as the methods of fixedly securing the gap covering members 126 and 129 shown in FIGS. 17 and 18, respectively, the methods as described above and shown in FIGS. 15 and 16, respectively, may be used.

Still more, regarding the above-mentioned gap covering members as shown in FIGS. 14 to 18, it is preferrable to form integrally the sheet-like upper portion and the leg portions by extrusion molding. Further, the height of the leg portions may be the same as the thickness of the floor panels 101 as shown in FIGS. 14 to 16, or the height may be shorter than the thickness of the floor panels 101 as shown in FIG. 17.

Figure 19:
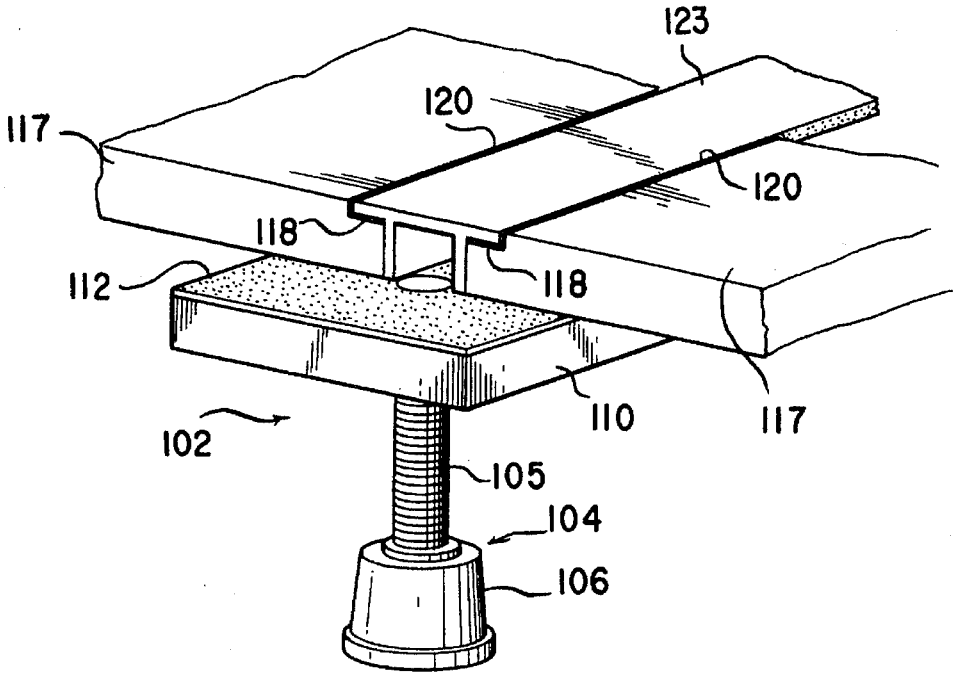
FIG. 19 is a fragmentary perspective view showing a further embodiment of the method of assembling a raised dry-floor according to the present invention.

FIG. 19 shows a modified example of the embodiment shown in FIG. 11. As the floor panels to be used in the above-mentioned method of assembling a raised dry-floor, floor panels 117 each having a lower step portion 118 formed in the marginal portion thereof are used, and the gap covering member as shown in FIG. 14 is fitted in the gap between the adjoining floor panels 117 in such a way as to cover the whole gap with said covering member, with the lower step portions 118 of the floor panels 117 serving as the supporting surfaces thereof. This gap covering member 123 has adhesive cushioning sheets 120 affixed on the portions thereof which are held in contact with the floor panels 117. The adhesive cushioning sheet 120 serves to adhesively bond the gap covering member 123 to the floor panels 117, prevent creak of the floor from occurring when a person walks thereon, and also absorb the expansion of the floor panels 117.

Figure 20:
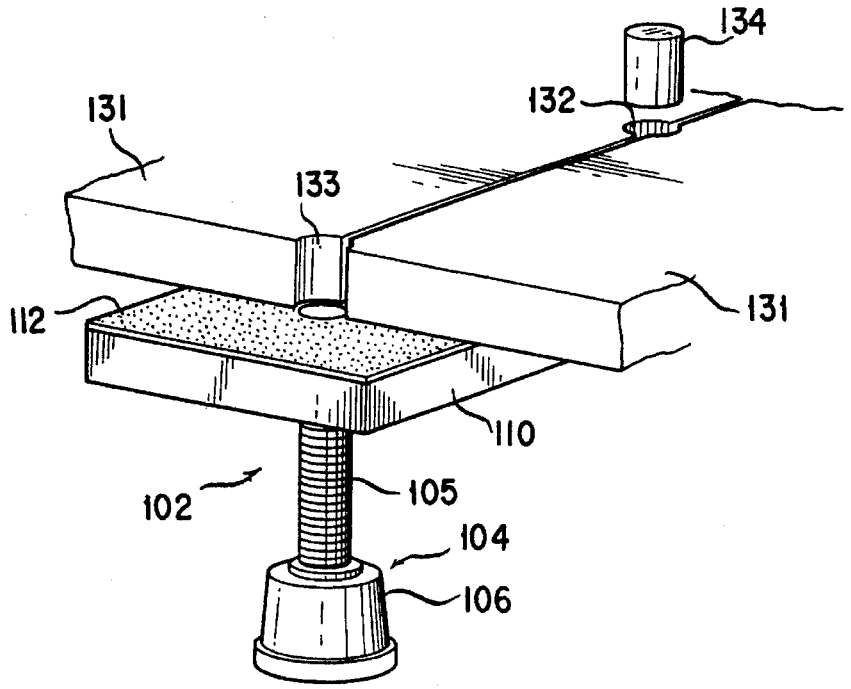
FIG. 20 is a fragmentary perspective view showing a still further embodiment of the method of assembling a raised dry-floor according to the present invention wherein floor panels are laid leaving extremely small gaps therebetween.

FIG. 20 shows an embodiment of another mode of the method of assembling a raised floor according to the present invention, which uses floor panels 131 having notches 132 and 133 formed along the marginal portions and at positions where the unit supporting legs 102 are disposed. Each of the notches has a minimum area which permits a supporting bolt 105 to be inserted therein. The unit supporting legs 102 are disposed at prescribed pitches corresponding to the spacing between the notches 132 and 133 formed along the marginal portions of the floor panels, and then the floor panels 131 are laid on the unit supporting legs 102 leaving a prescribed gap therebetween, which is so small that no cavity is formed in the floor even in case a cushioning floor covering sheet or the like is laid on the floor panels 131 and no problem arises from expansion and contraction of the floor panels 131.

Figure 21:
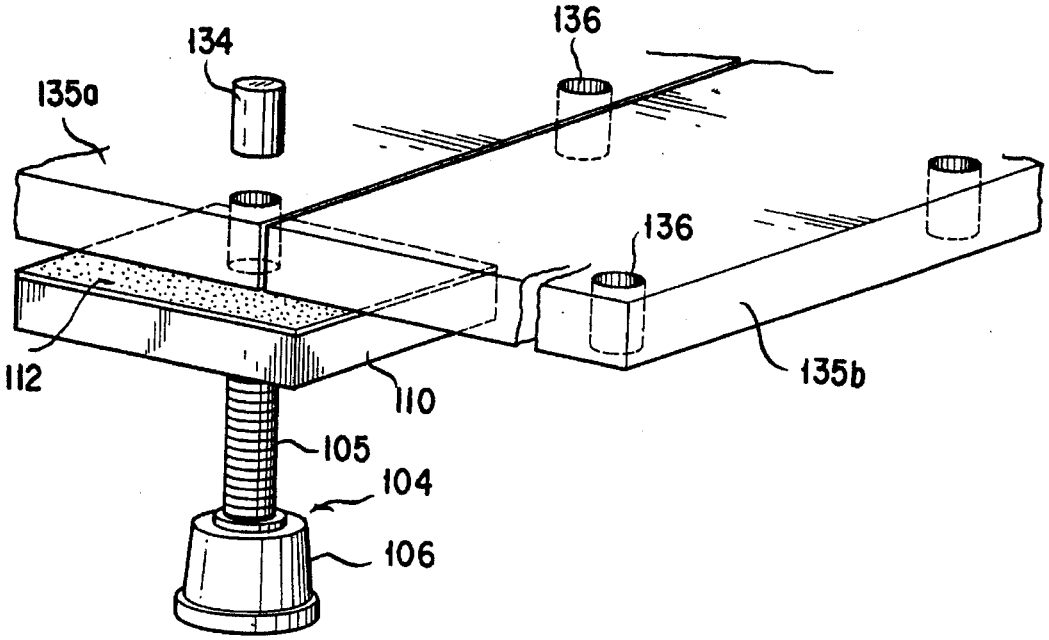
FIG. 21 is a fragmentary perspective view showing another embodiment of the method of assembling a raised dry-floor according to the present invention wherein floor panels are laid leaving extremely small gaps therebetween.
Figure 22:
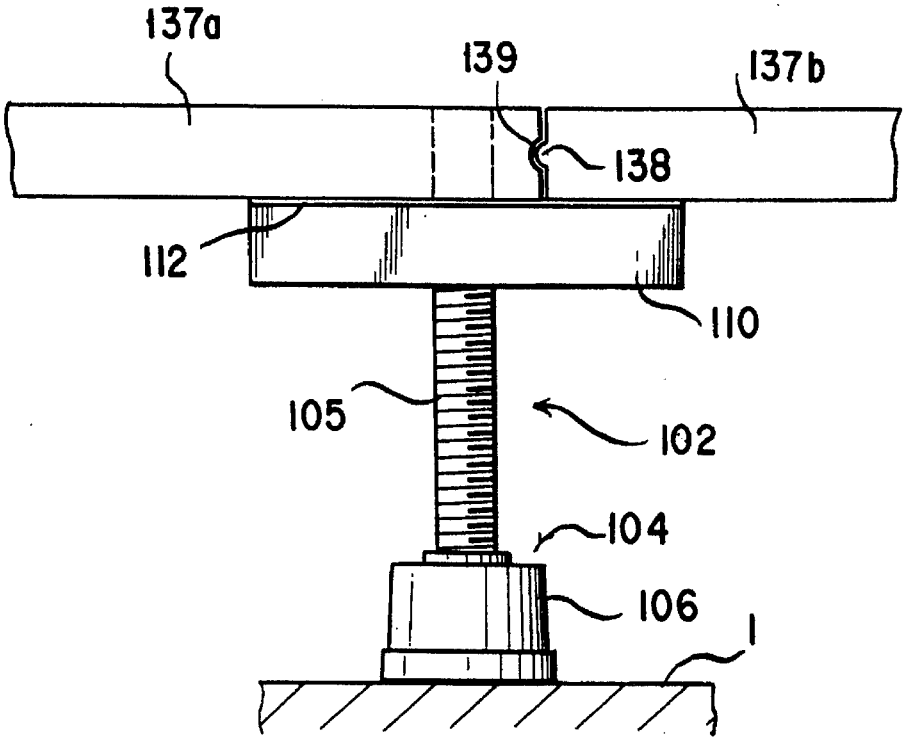
FIG. 22 is a fragmentary end view showing a modified example of the method of assembling a raised dry-floor shown in FIG. 21 wherein floor panels formed with a tongue and a groove, respectively are used.

FIG. 21 shows a variant of the embodiment shown in FIG. 20. In this variant, floor panels 135*a*, 135*b* each having holes 136 formed at predetermined positions (as shown in FIG. 21) in the marginal portion thereof corresponding to the insertion holes in the supporting plates 110 of the unit supporting legs 102 are used, and each of the holes 136 has a minimum area which enables the supporting bolt 105 to pass therethrough. After the unit supporting legs 102 are installed at the above-mentioned predetermined positions and the floor panel 135*a* is laid thereon, the next floor panel 135*b* is laid adjacent to the floor panel 135*a* leaving a predetermined extremely small gap therebetween so that it may be supported by the portions of the supporting plates 110 of the unit supporting legs 102 where the floor panel 135*a* is not mounted. Alternatively, in the case of this method, as shown in FIG. 22, floor panels 137*a* and 137*b* each having a longitudinally extending groove 139 formed in one end face thereof and a longitudinally extending tongue 138 formed in the opposite end face thereof may be used.

In the above-mentioned two methods as shown in FIGS. 20 and 21, the notches 132, 133 and the holes 136 for inserting a turning tool such as a driver or the like for the purpose of adjusting the levels of the supporting plates 110 of the unit supporting legs 102 are embedded with bolt covers 134 which are pin-like (or hollow cap-shaped) fitting members. Such bolt covers 134 are fitted in all of the notches or holes formed in the floor panels.

After the raised floor has been assembled on the whole of the foundation floor, the floor surface level is adjusted, and the holes 136 formed in the floor panels or the holes formed by a pair of notches 132 or two pairs of notches 133 of the adjoining floor panels are embedded with fitting members as described above, a floor covering material such as a cushioning floor covering sheet, a carpet or the like is laid thereon.

In the above-mentioned methods wherein a cushioning floor covering sheet, a carpet or the like is used as the floor covering material and intermediate plywood laminates are not used, it is preferrable to use special floor panels having a higher strength than those of floor panels used generally.

From the foregoing detailed description, it will be evident that there are a number of changes, adaptations, and modifications of the present invention which come within the province of those skilled in the art. However, it is intended that all such variations not departing from the spirit of the invention be considered as within the scope thereof as limited solely by the claims appended hereto.

What is claimed is:

1. A method of assembling a raised dry-floor having floor panels supported by a group of unit supporting legs, the method comprising the steps of:

providing a plurality of floor panels having a generally rectangular configuration and marginal portions extending along a periphery thereof;

providing a plurality of unit supporting legs each comprised of a rod-shaped leg member having a groove in an upper end face thereof and a supporting plate mounted on the upper end of the rod-shaped leg member in such a manner that it can be moved up and down to adjust the level thereof;

providing a gap covering member comprised of two or more elongated leg portions extending in a parallel relationship and a flat upper portion formed integrally with the leg portions, the flat upper portion connecting upper ends of the leg portions and having longitudinal marginal portions which project outwardly from the leg portions on opposite sides;

providing a plurality of double faced adhesive tapes having a width larger than that of said flat upper portion of said gap covering member;

disposing said unit supporting legs on a surface of a foundation floor at prescribed pitches corresponding to the configuration of said floor panels;

disposing said floor panels on said unit supporting legs leaving prescribed gaps substantially equal to the diameter of the upper end of said rod-shaped leg member between adjacent floor panels in such a manner that said floor panels are supported along their marginal portions by said unit supporting legs;

adjusting levels of the floor panels by fitting a leading end of a turning tool in the groove formed on the upper end face of the rod-shaped leg member through said gap and turning the rod-shaped leg member;

disposing said gap covering member in each of said prescribed gaps between adjacent floor panels, said step of disposing said gap covering member comprising inserting said leg portions of said covering member in said gaps between adjacent floor panels so that said longitudinal marginal portions of the flat upper portion rest on the marginal portions of said floor panels;

fixing said double-faced adhesive tape on each of said flat upper portions of said gap covering members and said marginal portions of said adjacent floor panels, so that said gap covering member is fixedly secured to the marginal portions of said adjacent floor panels; and laying a floor covering material on the assembled floor panels thereby fixedly securing said floor covering material thereonto by means of said double-faced adhesive tape.

2. A method according to claim 1, wherein said floor covering material is either one of a floor covering sheet and a carpet.

3. A method according to claim 1, wherein the leg portions formed on opposite sides of said gap covering member have outwardly projecting pawl portions formed integrally with the lower ends thereof.

4. A method according to claim 1, wherein said floor panel is made of wood.

5. A method of assembling a raised dry-floor having floor panels supported by a group of unit supporting legs, the method comprising the steps of:

providing a plurality of floor panels having a generally rectangular configuration and marginal portion extending along a periphery thereof;

providing a plurality of unit supporting legs each comprised of a rod-shaped leg member having a groove in an upper end face thereof and a supporting plate mounted on the upper end of the rod-shaped leg member in such a manner that it can be moved up and down to adjust the level thereof;

providing a gap covering member comprised of two or more elongated leg portions extending in a parallel relationship and a flat upper portion formed integrally with the leg portions, the flat upper portion connecting upper ends of the leg portions and having longitudinal marginal portions which project outwardly from the leg portions on opposite sides;

providing a plurality of double-faced adhesive tapes having a width larger than that of said longitudinal marginal portion of said gap covering member;

disposing said unit supporting legs on a surface of a foundation floor at prescribed pitches corresponding to the configuration of said floor panels;

disposing said floor panels on said unit supporting legs leaving prescribed gaps substantially equal to the diameter of the upper end of said rod-shaped leg member between adjacent floor panels in such a manner that said floor panels are supported along their marginal portions by said supporting legs;

adjusting levels of the floor panels by fitting a leading end of a turning tool in the groove formed on the upper end face of the rod-shaped leg member through said gap said turning the rod-shaped leg member;

fixing said double-faced adhesive tape on each of upper surfaces of the marginal portions of said floor panels;

disposing said gap covering member in each of said prescribed gaps between adjacent floor panels, said step of disposing said gap covering member comprising inserting said leg portions of said covering member in said gaps between adjacent floor panels so that said longitudinal marginal portions of the flat upper portion are fixedly secured onto the marginal portions of said floor panels by means of said double-faced adhesive tapes; and laying a floor covering material on the assembled floor panels so that said floor covering material is fixedly secured onto said floor panels by means of said double-faced adhesive tapes extending along said longitudinal marginal portions of the flat upper portion of said gap covering member.

6. A method according to claim 5, wherein said floor covering material is either one of a floor covering sheet and a carpet.

7. A method according to claim 5, wherein the leg portions formed on opposite sides of said gap covering member have outwardly projecting pawl portions formed integrally with the lower ends thereof.

8. A method according to claim 5, wherein said floor panel is made of wood.

* * * * *